United States Patent [19]

Hertel

[11] 4,008,861

[45] Feb. 22, 1977

[54] WEB ROLL RETAINER

[75] Inventor: Heinz E. Hertel, Mount Prospect, Ill.

[73] Assignee: Bell & Howell Company, Chicago, Ill.

[22] Filed: Aug. 18, 1975

[21] Appl. No.: 605,486

[52] U.S. Cl. ..... 242/68; 242/68.4

[51] Int. Cl.[2] ..... B65H 17/02

[58] Field of Search ..... 242/68, 68.4, 73

[56] References Cited

UNITED STATES PATENTS

| | | | |
|---|---|---|---|
| 862,109 | 7/1907 | Roth | 242/68.4 |
| 1,515,382 | 11/1924 | Cheesman | 242/68.4 |
| 2,134,043 | 10/1938 | Hoppe | 242/68.4 |
| 2,705,112 | 3/1955 | Baumgartner | 242/68 |

*Primary Examiner*—Edward J. McCarthy
*Attorney, Agent, or Firm*—Robert A. Walsh

[57] ABSTRACT

The disclosure relates to a web roll retainer for retaining a web roll and for maintaining constant resistance to rotation of the roll as the web is withdrawn. The web roll retainer includes an axial support member, a roll end support mounted at each end of the support bar in non-rotational relation to the support bar and end support holding means for maintaining the end supports in fixed axial relation on the support bar. Each end support includes an annular bearing surface for supporting a web roll extending between the end supports and for providing constant resistance to web roll rotation through friction resulting from the gravitational force between the web roll and the end support annular bearing surfaces.

10 Claims, 8 Drawing Figures

WEB ROLL RETAINER

BACKGROUND OF THE INVENTION

The present invention relates generally to a web roll retainer and in particular to a web roll retainer for retaining a paper supply roll in a microfiche reader-printer.

Web roll retainers are used in many environments. Such devices find considerable use in microfiche reader-printer machines. Web roll retainers for such machines must maintain the paper supply roll in a fixed lateral position relative to the machine cutter, paper track, and exposure area to assure proper functioning of the machine. Additionally, the web roll retainers must provide continuous resistance to paper supply roll rotation to avoid over-run of the roll and slag of the paper web when withdrawl of the paper is terminated. It is also important that the resistance to roll rotation be uniform on the roll to prevent skewing of the roll and resultant paper cutting problems. Lastly, paper rolls of different widths must be accomodated to provide efficient use of the machines.

While prior art web roll retainers have generally been successful, they have been expensive to manufacture and difficult to use.

It is therefore a general object of the present invention to provide a new and improved web roll retainer.

It is a still further object of the present invention to provide a web roll retainer which provides a uniform constant resistance to web roll rotation as the web is withdrawn from the roll.

It is a still further object of the present invention to provide a web roll retainer which confines the web roll to preclude lateral or axial movement of the web roll during withdrawl of the web from the roll.

It is a still further object of the present invention to provide a web roll retainer which is adapted to support web rolls of different widths.

SUMMARY OF THE INVENTION

The present invention provides a web roll retainer comprising an axial support bar having first and second ends, and first and second roll end supports mounted on the axial support bar in non-rotational relation to the support bar, the first end support being near the first end and the second end support being near the second end for supporting a web roll extending therebetween, and each of the first and second roll end supports including an annular bearing surface communicating with a web roll and web roll confining means for minimizing axial movement of the web roll on the end supports. The web roll retainer of the present invention also includes an end support holding means for maintaining the end supports in fixed axial relation on the support bar. As a result, as the web is withdrawn from the roll, the web roll confining means maintain the web roll in substantially fixed axial position and the annular bearing surfaces provide continuous resistance to web roll rotation through friction resulting from gravitational force between the web roll and the annular surfaces.

BRIEF DESCRIPTION OF THE DRAWINGS

The invention, together with the objects and advantages thereof, may best be understood by reference to the following description taken in conjunction with the accompanying drawings, and in the several figures of which like reference numerals identify like elements, and in which.

DESCRIPTION OF THE PREFERRED EMBODIMENT

Figure 1:
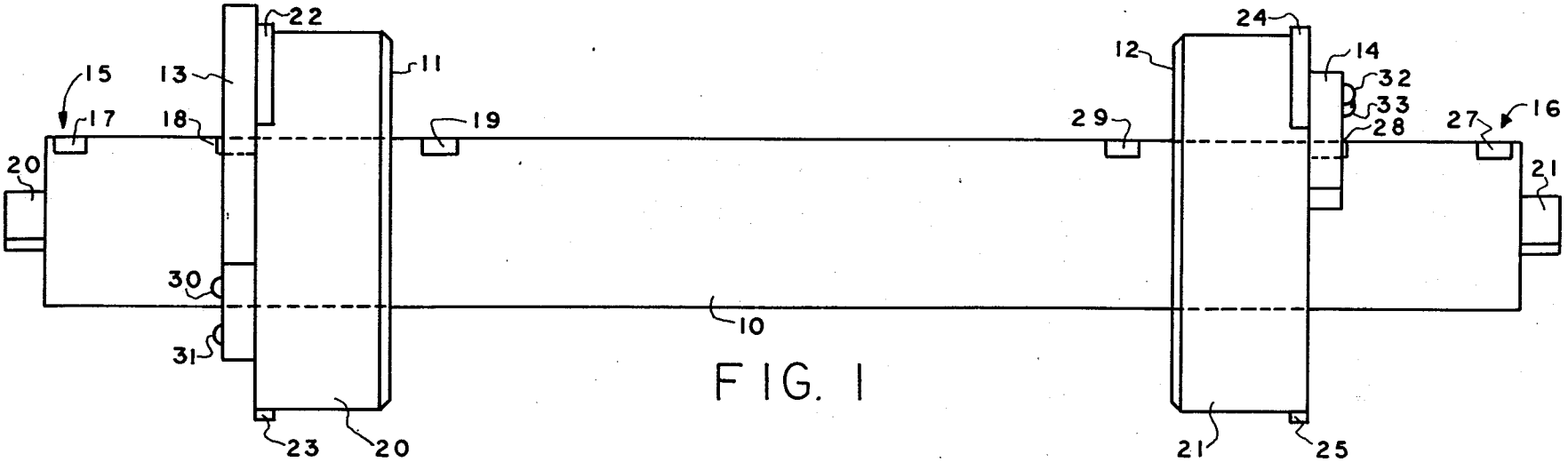
FIG. 1 is a side elevational view of a web roll retainer embodying the present invention.
Figure 2:
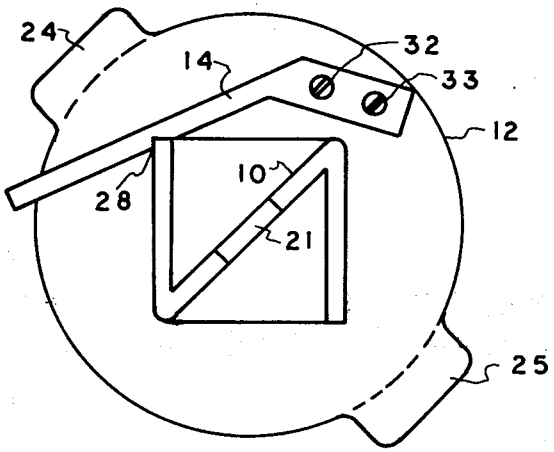
FIG. 2 is an end elevational view of the web roll retainer of FIG. 1.

Referring now to FIGS. 1 and 2, the web roll retainer thereshown comprises an axial support bar 10, a first roll end support 11, a second roll end support 12, and latch arms 13 and 14.

Axial support bar 10 includes a first end generally designated at 15 and a second end generally designated at 16. The support bar also includes a first set of axially spaced apart notches 17, 18 and 19 near the first end 15 and a second set of axially spaced apart notches 27, 28 and 29 located near the second end 16 of the support bar. Each notch of the first set of notches has a corresponding notch in the second set of notches which is axially spaced from the second end of the support bar by a distance equal to the axial spacing of the corresponding notches of the first set from the first end of the support bar.

The support bar also includes mounting extensions 20 and 21 extending from the first and second ends 15 and 16 respectively of the support bar. The mounting extensions are adapted to be received by a suitable slotted mounting bracket (not shown) for mounting the web roll retainer into the environment in which it is to be used and in fixed non-rotational relation.

The first roll end support 11 is mounted on the support bar 10 near the first end 15 and comprises a circular block having a peripheral surface 20 forming an annular bearing surface. The second roll end support similarly comprises a circular block having a major peripheral surface 21 forming an annular bearing surface and is located near the second end 16 of support bar 10. The roll end supports are adapted to receive and support a web roll (not shown) extending between the first and second roll end supports. Each of the roll end supports includes a web roll confining means comprising a segmented flange extending from the outward edges of the annular bearing surfaces. First end support 11 therefore includes flange segments 22 and 23 extending from the outward edge of annular bearing surface 20 and second roll end support 12 includes flange segments 24 and 25 extending from the outward edge of annular bearing surface 21. The segmented flanges confine the web roll extending between the end roll supports for minimizing the axial movement of the web roll which extends between the end supports.

Each of the end roll supports is additionally mounted in non-rotational relation with the support bar 10. To this end, support bar 10 has a generally "Z" cross-section and the first and second end roll supports 11 and 12 include an inner opening having a square cross-section being received by the "Z" cross-sectioned support bar 10.

The roll end supports 11 and 12 also includes latch arms 13 and 14 respectively which co-act with the notches of the support bar for maintaining the end supports in fixed axial relation on the support bar.

Latch arm 13 is mounted on the first roll end support 11 by screws 30 and 31 and latch arm 14 is mounted on a second roll end support 12 by screws 32 and 33. The second end roll support and latch are best seen in FIG. 2.

The latch arms are constructed out of resilient material such as plastic to spring load the latch arms into engagement with the notches on the support bar. When the spring loaded latches are disengaged from the notches, the end supports are slideable on support bar 10. The plurality of notches forming the first and second sets of notches are axially spaced so that the web roll retainer of FIG. 1 can accomodate web rolls of different widths and also for centering the end roll supports for in turn centering the web roll on the support bar. This assures that when the web is withdrawn from the roll the drag on the roll will be uniform preventing skewing of the web roll as the web is withdrawn.

In operation, a web roll may be mounted on the web roll retainer of FIGS. 1 and 2 by first releasing one of the latch arms and removing its corresponding end roll support from the support bar 10. The other end roll support which is still on the bar is then slid on the bar for engagement between its latch arm and the appropriate notch corresponding to the width of the web roll to be mounted. The web roll is then slid onto the end support which is on the bar and the other end support is then slid back onto the support bar and shifted in an axial direction to cause its annular bearing surface to receive the free end of the web roll. The latch arm is then engaged with the appropriate notch corresponding to the notch utilized on the opposite end support to thereby fix the axial relation between the end supports and to center the web roll on the support bar. The web roll retainer and web roll are then mounted into its appropriate mounting brackets of the machine into which is utilized and the web is withdrawn from the roll and threaded through the machine.

The end roll support flanges confine the web roll to thereby maintain the web roll in a substantially fixed axial position. However, it is to be understood that a small degree of axial movement freedom of the roll is necessary in order to allow the web roll to rotate as the web is withdrawn.

The end roll supports may be constructed out of a material such as high density polyethylene plastic to cause a frictional force to occur between the web roll and the annular bearing surfaces through the gravitational force between the web roll and the annular bearing surfaces. The gravitational force and friction thereby resulting causes a continuous resistance to web roll rotation to ensue which prevents web roll over-run and web slag when the web withdrawl is terminated.

Figure 3:
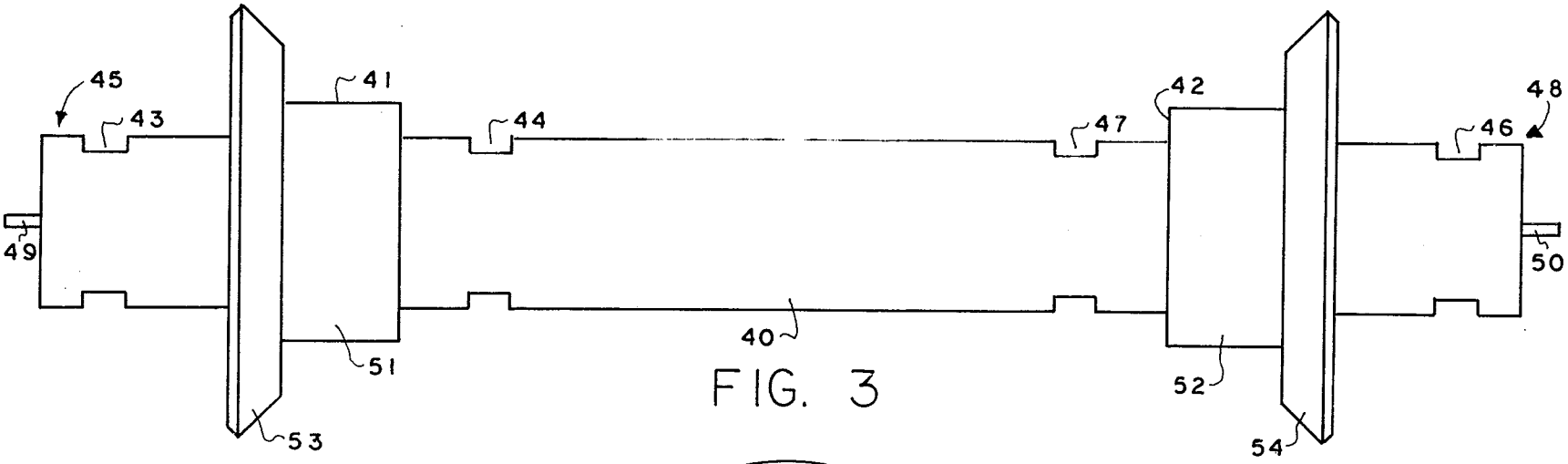
FIG. 3 is a side elevational view of another web roll retainer embodying the present invention.
Figure 4:
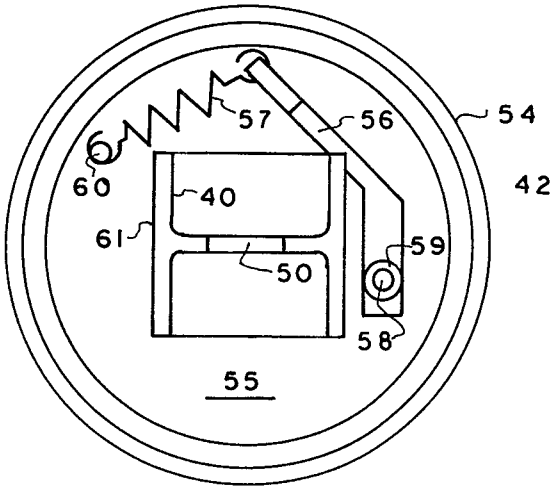
FIG. 4 is an elevational view of the web roll retainer of FIG. 3.

Referring now to FIGS. 3 and 4, the web roll retainer thereshown includes an axial support bar 40, a first end roll support 41, and a second end roll support 42.

The axial support bar 40 is similar to the axial support bar 10 of FIG. 1 in that is also includes a first set of notches comprising three notches, notches 43 and 44 being shown at the first end 45 of bar 40, and a second set of notches including three notches, notches 46 and 47 being shown at the second end 48 of the bar 40. The support bar 40 also includes mounting extensions 49 and 50 extending from the first end 45 and second end 48 respectively of the support bar. The mounting extensions serve the same functions as the mounting extensions 20 and 21 of FIG. 1.

Each of the supports 41 and 42 comprises a circular block having a major peripheral surface forming an annular bearing surface. End support 41 includes annular bearing surface 51 and end support 42 includes annular bearing surface 52. As in the web roll retainer of FIG. 1, the annular bearing surfaces 51 and 52 support a web roll extending between the end supports 41 and 42.

The end supports also include a web roll confining flange, end support 41 having flange 53 and end support 42 having flange 54. The flanges confine the axial movement of the web roll extending between the end supports in the same manner as described in relation to the web roll retainer of FIG. 1.

Each of the end supports also has a latch arm associated with it, one such latch arm being shown in FIG. 4 which is associated with end support 42. As illustrated in FIG. 4, flange 54 is hollowed out forming a hollow inner portion 55 which includes latch arm 56 and spring 57. Latch arm 56 is pivotably mounted on the hollowed out portion 55 of flange 54 on post 58 and is confined on post 58 by a lock washer or self locking retainer 59. The other end of latch arm 56 is connected to spring 57 which is secured to post 60 of hollowed out portion 55. Thus, latch arm 56 is spring loaded for engagement with the second set of notches.

The end roll supports are mounted on bar 40 in non-rotational relation. To this end, bar 40 comprises a generally H cross-section and each of the end roll support has a generally square opening to be received by the bar 40. One such square opening is shown in FIG. 4 in relation to end roll support 42 and is designated at 61.

Because the operation of the web roll retainer of FIGS. 3 and 4 is substantially identical to the operation of the web roll retainers of FIGS. 1 and 2, its operation will not be described in detail. The various parts of the web roll retainers of FIGS. 3 and 4 may be constructed out of a plastic material such as a high density polyethylene material. This applys to the axial support bar 40, the end roll supports 41 and 42 and their associated flanges 53 and 54 respectively and also to the latch arms.

The present invention therefore provides a web roll retainer which is considerably less expensive to manufacture then the web roll retainers of the prior art. Because essentially all of the parts of the web roll retainer of the present invention may be constructed out of a plastic material, they may be readily molded on a high production bases. Also, because there are very few moving parts, the operation and manufacture of the web roll retainer of the present invention is considerably simplified. It has been found in practice that the amount of resistance to web roll rotation, created by the gravitational force between the web roll and the annular bearing surfaces, properly decreases as the web is made smaller in diameter through the use of the web roll. When the web roll is larger, it will experience a greater amount of inertia force for continued rotation than when the web roll is smaller in diameter. When the web roll is larger, a greater amount of resistance to rotation is provided by the fact that the web roll, when larger, will have a greater mass and thus will cause a greater amount of rotational force friction to be provided between the web roll and the annular bearing surface. As a result, as the inertia forces to maintain web roll rotation decrease, the resistance to web roll rotation correspondingly decreases.

Additionally, the present invention provides a web roll retainer which can accomodate different widths of web rolls and also centers the web rolls on the web roll retainer to minimize skewing during use. The web roll confining flanges also minimize axial movement of the web roll as the web is withdrawn to thereby assure proper functioning of the web as it is utilized by the machine incorporating the web roll retainer.

While particular embodiments of the invention have been shown and described, modifications may be made, and it is intended in the appended claims to cover all such modifications as may fall within the true spirit and scope of the invention.

We claim:

1. A web roll retainer comprising:

an axial support bar having first and second ends;

first and second roll end supports mounted on said axial support bar in non-rotational relation to said support bar, said first end support being near said first end and said second end support being near said second end for supporting a web roll extending therebetween, and each of said first and second roll end supports including an annular bearing surface communicating with the web roll and web roll confining means for minimizing axial movement of the web roll on said end supports; and end support holding means for maintaining said end supports in fixed axial relation on said support bar wherein said end support holding means includes at least one notch in said support bar near said first and second ends and a latch on each roll end support, a respective given one of said latches engaged with a respective given one of said notches to thereby maintain said end supports in fixed axial relation on said support bar; whereby, as the web is withdrawn from the roll, said web roll confining means maintain the web roll in substantially fixed axial position and said annular bearing surfaces provide continuous resistance to web roll rotation through friction resulting from the gravitational force between the web roll and said annular surfaces.

2. A web roll retainer in accordance with claim 1 wherein said web roll confining means of each said roll end support comprises a flange extending from the outward edge of said annular bearing surfaces.

3. A web roll retainer in accordance with claim 2 wherein said flange of each said roll end support is a partial flange comprising a plurality of segments.

4. A web roll retainer in accordance with claim 1 wherein each of said roll end supports comprise a circular block having a major peripheral surface forming said annular bearing surface.

5. A web roll retainer in accordance with claim 4 wherein said web roll confining means of each said roll end support comprises a flange extending from the outer edge of said major peripheral surface.

6. A web roll retainer in accordance with claim 1 wherein in each said latch comprises a spring loaded arm, said spring loads maintaining said arms in engagement with said notches.

7. A web roll retainer comprising:

an axial support bar having first and second ends;

first and second roll end supports mounted on said axial support bar in non-rotational relation to said support bar, said first end support being near said first end and said second end support being near said second end for supporting a web roll extending therebetween, and each of said first and second roll end supports including an annular bearing surface communicating with the web roll and web roll confining means for minimizing axial movement of the web roll on said end supports; and end support holding means for maintaining said end supports in fixed axial relation on said support bar wherein said end support holding means comprises first and second sets of axially spaced apart notches in said support bar, said first set being near said first end and said second set being near said second end, and a latch on each of said first end second roll end supports, said first end support latch engaged with one of said notches of said first set and said second end support latch engaged with one of said notches of said second set to thereby maintain said end supports in fixed axial relation on said support bar; whereby, as the web is withdrawn from the roll, said web roll confining means maintain the web roll in substantially fixed axial position and said annular bearing surfaces provide continuous resistance to web roll rotation through friction resulting from the gravitational force between the web roll and said annular surfaces.

8. A web roll retainer in accordance with claim 7 wherein each of said latches comprises a spring loaded arm.

9. A web roll retainer in accordance with claim 7 wherein each said notch of said first set has a corresponding notch of said second set, said corresponding notches being equally spaced from their respective support bar ends and wherein said first and second roll end supports are axially slideable along said support bar between said notches to thereby render the axial distance between said roll end supports adjustable and the relative spacing of said roll end supports centered on said support bar.

10. A web roll retainer comprising:

an axial support bar having first and second ends and a first set of axially spaced apart notches near said first end and a second set of axially spaced apart notches near said second end, each said notch of said first set having a corresponding notch of said second set spaced from said second end by a distance equal to the distance between its corresponding notch of said first set from said first end;

first and second circular roll end supports mounted on said axial support bar in non-rotational relation to said support bar, said first end support being near said first end and said second end support being near said second end for supporting a web roll extending therebetween, each said roll end support including a major peripheral surface forming an annular bearing surface communicating with the web roll and a flange extending from said major peripheral surface for confining axial movement of the web roll on said end supports; and a spring loaded latch arm on each roll end support for engaging said notches and holding said first roll end support axially fixed near said first end and said second roll end support axially fixed near said second end; whereby, with said support bar having said first and second corresponding sets of notches, the spacing of said roll end supports may be centered on said support bar and adjusted for web rolls of different widths, and as the web is withdrawn from the roll, said flanges maintain the web roll in substantially fixed axial position and said annular bearing surfaces provide continuous resistance to web roll rotation through friction resulting from the gravitational force between the web roll and said annular surfaces.

* * * * *